US006072407A

United States Patent [19]

Shin

[11] Patent Number: 6,072,407

[45] Date of Patent: Jun. 6, 2000

[54] VARIABLE MESSAGE TRAFFIC SIGNAL LAMP

[75] Inventor: Bu-Yong Shin, Seoul, Rep. of Korea

[73] Assignee: Transportation & Environment Research Institute Ltd., Seoul, Rep. of Korea

[21] Appl. No.: 09/154,592

[22] Filed: Sep. 17, 1998

[30] Foreign Application Priority Data

Dec. 23, 1997 [KR] Rep. of Korea ..... 97-72160

[51] Int. Cl.[7] ..... G08G 1/095

[52] U.S. Cl. ..... 340/907; 345/83; 345/151; 362/240; 362/293

[58] Field of Search ..... 345/83, 151; 340/815.56, 340/815.75, 928, 929, 905, 925, 944, 702, 782, 707, 780; 362/240, 293, 800, 812

[56] References Cited

U.S. PATENT DOCUMENTS

| | | | |
|---|---|---|---|
| 3,234,506 | 2/1966 | Hines | 340/928 |
| 4,271,408 | 6/1981 | Teshima et al. | 340/702 |
| 5,150,116 | 9/1992 | West | 340/928 |
| 5,519,390 | 5/1996 | Casini | 340/929 |
| 5,917,431 | 6/1997 | Sanada et al. | 340/905 |

*Primary Examiner*—Jeffery A. Hofsass
*Assistant Examiner*—Hung Nguyen
*Attorney, Agent, or Firm*—Arent Fox Kintner Plotkin & Kahn, PLLC

[57] ABSTRACT

A variable message traffic signal lamp comprising a single (LED) imbedded face, capable of displaying appropriate signal lights, symbols, or even character messages on the face, thus simplifying the design and the structure of the traffic signal head set so that fabrication and installation costs of traffic signal lights are reduced, and reducing power consumption and maintenance costs through the use of LED's, and displaying messages including not only the conventional traffic signal lights but also the progression of the signal phase in display so that one can predict the change of the current phase and prepare for it.

5 Claims, 6 Drawing Sheets

VARIABLE MESSAGE TRAFFIC SIGNAL LAMP

BACKGROUND OF THE INVENTION

1. Field of the Invention

The present invention is directed to a traffic signal lamp, and in particular to a variable message traffic signal (hereinafter, referred to as "VMTS") lamp capable of displaying various signal lights or messages in accordance with predetermined signal plans.

2. Description of the Background Art

Traffic signal lights composed of a plurality of lamps each having a single color or symbol are generally installed at intersection approaches in order to control the flow of automobiles and pedestrians therethrough.

A conventional traffic signal light includes several lamps, each lamp adopted in a casing equipped with an electric bulb and a color lens at the front side thereof, the color lens being red, green, amber or showing other symbols in accordance with traffic signal messages to be displayed.

Traffic signal lights are displayed in a number of fashions. Firstly, the traffic signal lights are divided into automobile use and pedestrian use. The former is operated basically by green and red lamps to show a green phase meaning proceed, and a red phase meaning stop, and may be supplemented by an amber lamp to warn of the change of a green phase into a red phase. The green phase may be supplemented with a leading left-turn phase or a lagging left-turn phase to specify left-turn provision. In order to display the leading or lagging left-turn phases an additional lamp showing an arrow pointing to the left side is adopted to the traffic signal head. It is also possible to have a combined phase to allow straight-through and left-turn traffic at the same time. This synchronous phase can be displayed by lighting up the green lamp and the left-turn arrow lamp simultaneously, or alternatively, using a specially designed two-leg arrow with legs pointing respectively forward and leftward.

Alternatively, as in Ontario, Canada, for example, the synchronous phase is displayed by flashing the green lamp.

The latter, a pedestrian traffic signal light, is operated simply by a green lamp meaning proceed and a red lamp meaning stop, without any warning amber lamp. The green and red lamps may be substituted by words such as "walk", and "stop" or even by symbols such as a man walking, or a palm to indicate don't walk. Lastly, there is also a variable traffic lane signal lamp capable of showing a green arrow pointing downward or a red "X".

Furthermore, the green, red and amber lamps can be used in a flashing fashion. For example, a flashing single amber lamp may be adopted at locations where drivers' attention to safety is required.

As explained above, a traffic signal head may contain up to four lamps of various colors, symbols or even characters. These numerous fashions of signal lamps require numerous design standards and regulations thus raising complexity in traffic signal design and operations. Also, a traffic signal head may become structurally huge and heavy, thereby resulting in high fabrication and installation cost. Furthermore, the big size and the weight of the traffic signal head require a strong supporting structure to be able to resist against the wind force.

The conventional traffic signal lamps for automobiles are arranged vertically or horizontally. However, the lamps for pedestrians are usually arranged in a vertical direction.

The red light is displayed at the top in the case of a vertical arrangement, and at the far left in the case of a horizontal arrangement, and the green light is displayed at the bottom and far right in the respective cases, and thus one can distinguish signal messages by the position thereof. That is, when a signal lamp is turned on and illuminating, then even one with color blindness or impaired color vision can distinguish the signal messages by the positions of the lighted and extinguished signal lamps.

Today's traffic signal lights are displayed by lighting up an electric bulb of a lamp or lamps selected from the set of lamps as mentioned above. The selection of appropriate lamp(s) is made through a signal phase plan, which designates the sequence and the duration of such signal phases as green, amber and red for each signal head installed at each approach of an intersection. Traffic situations can vary by the time of a day and each such traffic situation require a specific signal phase plan. For example, in the morning rush hour, a different signal phase plan is required from the evening rush hour or off-peak hours. In order to select an appropriate phase plan at the right time, and operate the selected plan by switching on or off the signal lamps, an instrument called, a traffic signal controller, housed in a weather-proof case is installed normally on the ground separated from the signal head.

This conventional signal system comprising numerous electric lamps and an electromechanical switching mechanism consumes a substantial amount of electric power compared with modern electronic technologies, and requires frequent replacement of bulbs and parts, and careful maintenance. All these outdated technologies result in high total cost and environmental burden.

Despite the complex structure of the traffic signal head, the conventional traffic signal lights convey only simple messages such as to proceed, turn left, or stop. This is because each lamp can display only one message when it is lighted.

SUMMARY OF THE INVENTION

It is therefore a primary object of the present invention to provide a traffic signal head adopting only a single lamp but capable of displaying any required traffic signal light, symbol or message in accordance with a pre-programmed set of plans by utilizing such modern technologies as Light Emitting Diodes (LEDs) for luminance, and programmable microprocessors and remote controllers for its signal controlling mechanism.

It is another object of the present invention to provide a VMTS lamp as described above, which can display the progress of a current signal phase by means of a sub-signal separately adopted from the main signal but still on the same lamp face, with the sub-signal being diminishing gradually so that one can judge the time when the current phase will be terminated by glancing at the remaining portion of the sub-signal and can prepare for the change of the current phase.

It is another object of the present invention to provide a VMTS lamp, which can optionally display, in addition to the main and the sub-signal messages as described above, some variable message signs such as NO LEFT TURN, NO RIGHT TURN ON RED, CONGESTION AHEAD etc., by extending the lamp surface for such messages.

It is still another object of the present invention to provide a VMTS lamp of a simple design and of a simple structure which can be installed more easily and with less costs, with less maintenance cost.

It is still another object of the present invention to provide a portable VMTS lamp of a simple design and of a simple structure which can be carried and installed temporarily to control the traffic at such locations as construction or accident sites, or where the regular traffic signal lights are out of order or not installed but required immediately.

It is still another object of the present invention to provide a VMTS lamp of a standardized design which however contains therein a function of displaying an appropriate signal plan for almost any traffic circumstance, that is, an all purpose standardized signal lamp can be introduced and manufactured cost-effectively.

It is still another object of the present invention to provide a VMTS lamp which contains various signal phase plans for almost any traffic circumstance, and with a controlling unit that selects the required phase plans and carry out switching mechanism included in the lamp itself, which controlling unit can be manipulated through a remote controlling mechanism.

In order to achieve the above-described objects, the VMTS lamp of the present invention includes a main signal display area where conventional signal messages are displayed, and a sub-signal display area adopted besides the main signal display area, and yet another optional area specially adopted for variable message signs, but the optional area may be included only when warranted.

BRIEF DESCRIPTION OF THE DRAWINGS

The present invention will become better understood with reference to the accompanying drawings which are given only by way of illustration and thus are not limitative of the present invention, wherein:

FIGS. 1A, 1B and 2 illustrate the face, or the front view of the VMTS lamp, wherein:

FIG. 1A is a front view of a typical VMTS lamp of the present invention, and FIG. 1B is a front view of a VMTS lamp of the present invention with the optional area for variable message signs;

FIG. 2 is an enlarged view of portion "A" in FIGS. 1A and 1B;

DETAILED DESCRIPTION OF THE INVENTION

The variable message traffic signal (VMTS) lamp of the present invention will now be described in detail with reference to the accompanying drawings.

Figure 1A:
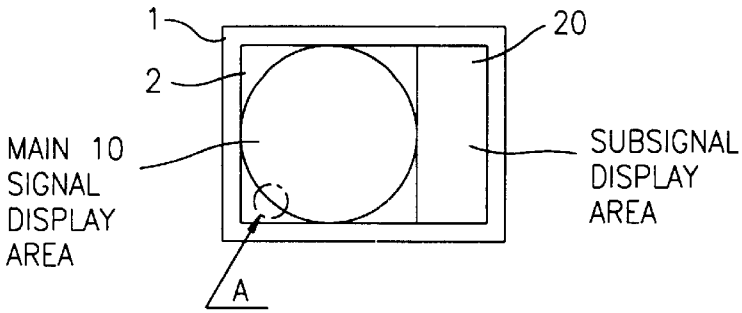

FIG. 1A illustrates the face or the front view of the VMTS lamp of the present invention wherein: reference numerals 1 and 2 in FIG. 1A respectively represent a casing forming an outer shape of the VMTS lamp and a hood blocking external light. The casing 1 and the hood 2 are formed in an almost identical shape to the conventional casing and hood except for their size and shape. The casing 1 and the hood 2 are not limited to a rectangular shape, as shown in FIG. 1A, but can be formed in various shapes such as a circle and an oval as the overall design of the VMTS lamp alters.

Figure 1B:
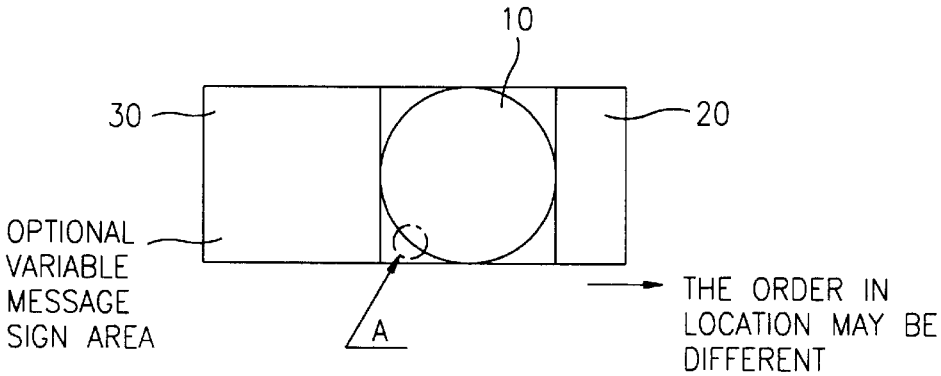
Figure 2:
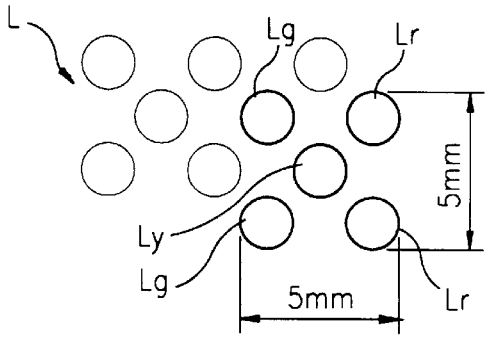

As illustrated in FIG. 2, a plurality of light emitting elements L are provided over the entire area of the face of the VMTS lamp including a main signal display area 10, a sub-signal display area 20, and an optional variable message sign area 30 as shown in FIGS. 1A and 1B.

As shown in FIG. 2, green, red and amber light emitting diodes LEDs Lg, Lr, Ly are regularly arranged over the entire face of the lamp, the LEDs, Lg, Lr, Ly being preferably bundled up into a single assembly called a pixel. One pixel is preferably composed of two green LEDs Lg, two red LEDs Lr and an amber LED Ly. However, the amber LEDs Ly may be omitted because amber light can be emitted by illuminating green and red LEDs simultaneously in a certain proportion. This arrangement is of course not fixed, and alternative compositions may be adopted as required.

The diameter of the main signal area 10 in FIGS. 1A and 1B is intended to conform with the current Government Uniform Standards and may for example be 300 mm, and the width of the sub-signal area 20 should be wide enough for good visibility, requiring a width of 100 mm or more. The optional variable message sign area 30 should not be too wide for structural reasons but should be wide enough to display simple messages.

The location of the sub-signal area can be at the right or left of the main signal area depending on the color of the signal, as will be explained below in reference to FIGS. 3A to 3F, and the optional variable message sign area 30 may be adopted at the right or left of the main signal area depending on the situation.

The manner of displaying the sequence of a typical signal cycle in the VMTS lamp of the present invention will now be explained.

Figure 3A:
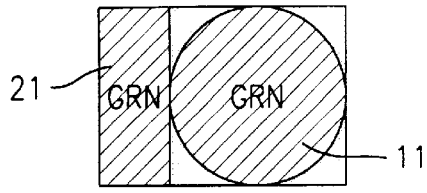
FIGS. 3A to 3F show how the sequence of a typical signal cycle is displayed in the VMTS lamp of the present invention.

First, FIG. 3A shows the signal state at the beginning of a green phase: the main signal display area emanates a solid green light 11, and the sub-signal display area shows a full bar of green light 21 to indicate that the green phase has just started. The sub-signal or the green bar is adopted at the left of the main signal to indicate that the far right side of the lamp is being illuminated. This is to relate to the conventional traffic signal method where the green lamp is always adopted at the far right side in the case of a horizontal arrangement, and at the bottom in the case of a vertical arrangement. Thus, as mentioned earlier, people with color blindness or color impairment may be able to tell that a green light is being displayed when the far right side of the signal lamp is illuminated.

Figure 3B:
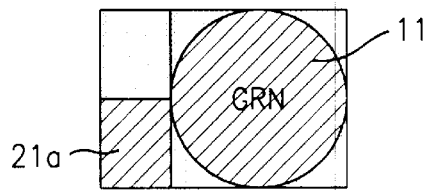

In FIG. 3B, one can tell from the remaining portion of the sub-signal or the green bar 21*a* that the green phase has progressed halfway.

Figure 3C:
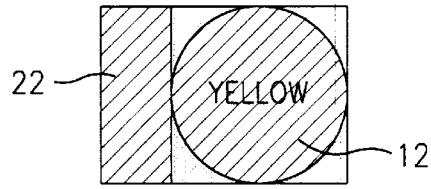
Figure 3D:
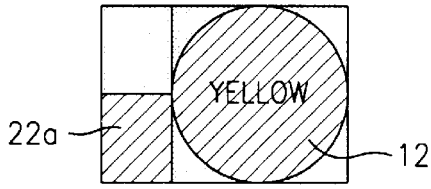

In FIGS. 3C and 3D an amber phase is illustrated in the same manner. However, an amber period lasts normally for 3 to 5 seconds and the sub-signal for an amber phase 22 would not convey too much meaning: Therefore the sub-signal for an amber signal 22 or 22*a* may be omitted.

Figure 3E:
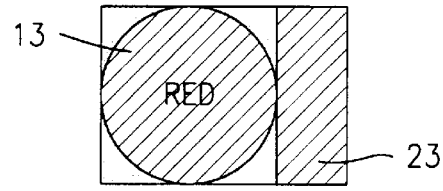
Figure 3F:
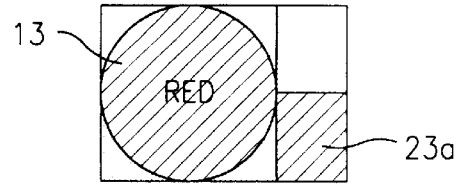

FIGS. 3E and 3F illustrate the progress of a red signal phase in a similar manner to FIGS. 3A and 3B: at the beginning of a red phase the red light or the main signal 13, and the sub-signal or the solid red bar 23 are illuminated, and the red bar starts to diminish. FIG. 3F shows that the red signal phase has progressed halfway as indicated by the sub-signal 23*a* that is reduced to half its initial size.

Figure 4A:
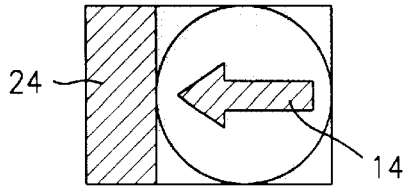
FIGS. 4A to 4D show how an exclusive left-turn phase and a synchronous left-turn phase are displayed in the VMTS lamp of the present invention.
Figure 4B:
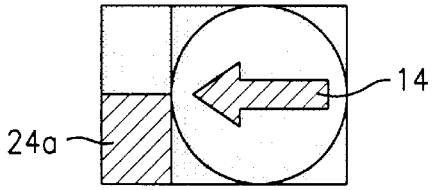

FIGS. 4A and 4B show how an exclusive left turn phase can be displayed in the same manner: at the beginning of an exclusive left turn phase the left turn arrow 14 and the full green bar 24 are illuminated, and the green bar starts to diminish. In FIG. 4B the green bar 24*a* is at half its initial size to indicate that the exclusive left turn phase has progressed halfway.

Figure 4C:
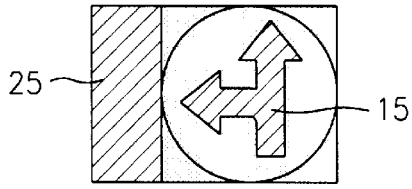
Figure 4D:
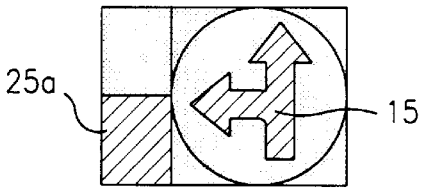

FIGS. 4C and 4D show a synchronous left turn phase in the same manner: at the beginning of a synchronous left turn phase the two-leg arrow 15 and the green bar 25 are illuminated, and the green bar starts to diminish. In FIG. 4D, the green bar 25*a* is at half its initial size to indicate that the synchronous left turn phase has progressed halfway.

Figure 5A:
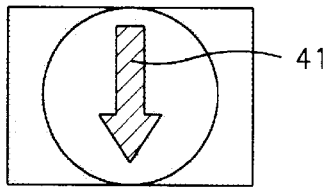
FIGS. 5A and 5B illustrate symbols displayed to control alternating traffic lanes.
Figure 5B:
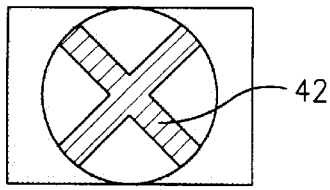

FIGS. 5A and 5B show the signal messages for the alternating lanes: in FIG. 5A, the green arrow 41 pointing downwards indicates the traffic lane in which traffic flow is allowed to proceed, and the cross in FIG. 5B indicates the interception lane in which traffic flow is prohibited. For both cases no sub-signal is required.

Figure 6A:
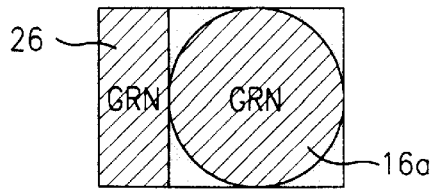
FIGS. 6 to 7 show examples of symbols often used for controlling pedestrian movements.

FIGS. 6A to 7C illustrate pedestrian signals in accordance with a VMTS lamp of the present invention: FIG. 6A shows an example of a pedestrian PROCEED signal design with a solid green light as the main signal and a green bar as a sub-signal. When a solid green or red light is used for the pedestrian, signal, the size of the light is normally smaller than that used for an automobile signal light. However as mentioned earlier, the present invention enables to adopt one size lamp for all signal messages, and designs identical to automobile signals can be used for pedestrian signals as shown in FIGS. 6A and 7A. However, the luminance of the main signal 16*a* and 17*a*, and the sub-signals 26 and 27 shown in FIGS. 6A and 7A for pedestrian signals may be made weaker than the counterparts for automobiles 11 and 21, respectively, to avoid glaring.

Figure 6B:
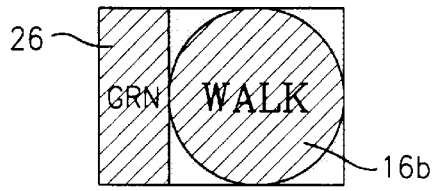
Figure 6C:
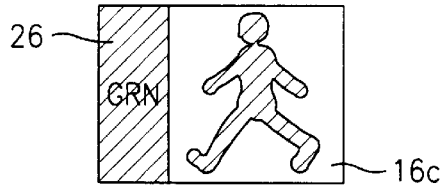
Figure 7A:
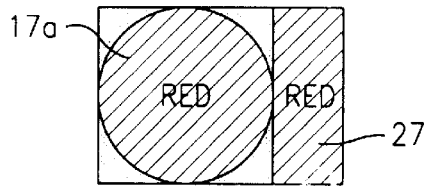
Figure 7B:
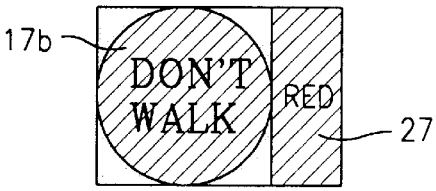
Figure 7C:
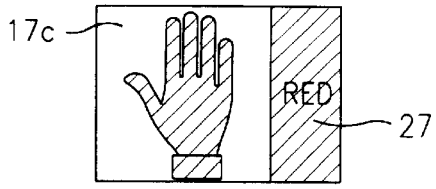

FIGS. 6B and 6C show other examples of pedestrian PROCEED signals, and FIGS. 7B and 7C show other examples of pedestrian STOP signals.

However these samples are by no means exclusive and there can be numerous other possible designs for pedestrian signals.

Figure 8A:
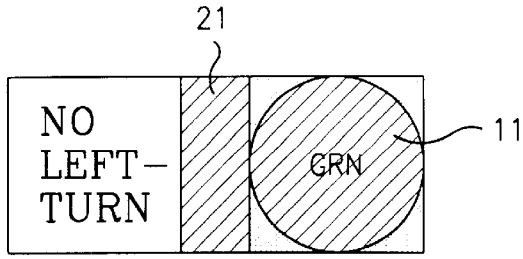
FIGS. 8A and 8B show examples of the VMTS lamp of the present invention employing the option of showing variable message signs together with the main and the sub-signal messages.
Figure 8B:
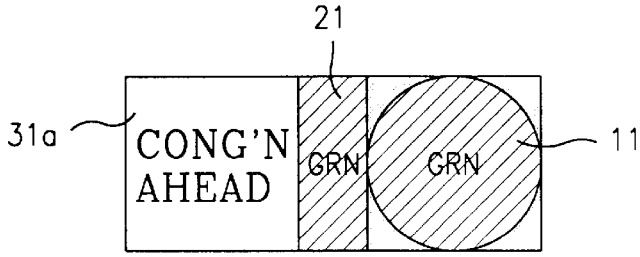

FIGS. 8A and 8B show two examples of using optional variable message signs attached to the VMTS lamp of the present invention. In FIG. 8A a 'NO LEFT TURN' sign is displayed together with the main signal 11 and the sub-signal 21, and in FIG. 8B a 'CONGESTION AHEAD' sign is displayed together with the main signal 11 and the sub-signal 21.

Figure 9A:
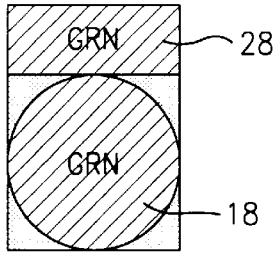
FIGS. 9 to 10 show examples of different shapes and locations of the sub-signal.
Figure 9B:
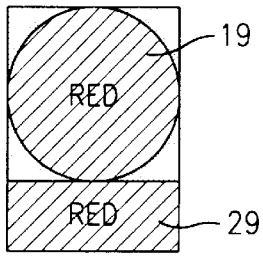
Figure 9C:
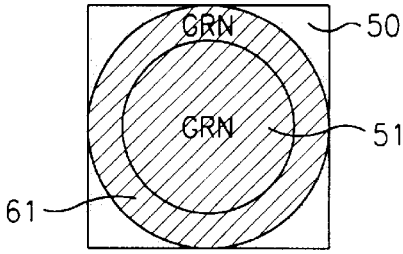

FIGS. 9A through 9C illustrate how the sub-signals may be adopted in different locations on the face of the VMTS lamp: in FIG. 9A the sub-signal 28 is adopted above the main signal 18 to have the green light 18 at the bottom of the traffic signal head as in the conventional arrangement; and in FIG. 9B the sub-signal 29 is adopted below the main signal 19 to have the red light 19 at the top of the traffic signal head as in the conventional arrangement.

As was mentioned earlier, people with color blindness or impairment may judge the color of the signal light in a display from the location of the lamp being illuminated, and it is therefore preferred to maintain the usual location of the red or green light on the face of the VMTS lamp of the present invention.

Figure 9D:
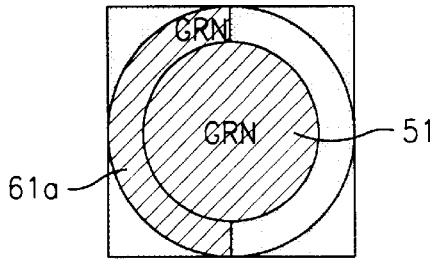

FIGS. 9C and 9D show another example of adopting different shapes of the sub-signal. In FIG. 9C, a circular shaped sub-signal 61 is adopted peripherally around the main signal 51, and in FIG. 9D the half extinguished area of sub-signal 61*a* indicates that the signal phase in display has progressed halfway.

Figure 10A:
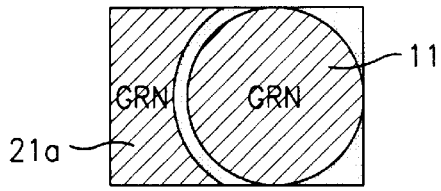
Figure 10B:
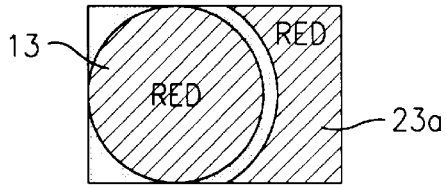
Figure 10C:
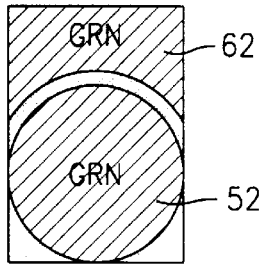
Figure 10D:
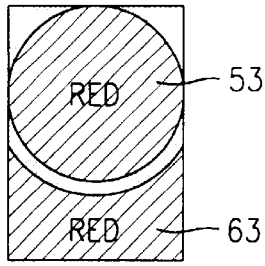

FIGS. 10A to 10D show yet another possible shape of the sub-signals, where a crescent with a rectangular outer border is adopted as the shape of the sub-signal for a maximum use of the surface area. FIGS. 10A and 10B show a case where the main and the sub-signals are arranged horizontally, and FIGS. 10C and 10D show a case where the main and the sub-signals are arranged vertically.

There can be other possibilities of having different shapes of sub-signal in different arrangements consistent with the concept of showing VMTS as presented in this invention.

The present invention is not limited to the above-described embodiments. For instance, a portable traffic signal lamp for temporary use at construction sites or accident sites may also be fabricated by utilizing the advantages of the small-sized, lightweight and simplified structure of the traffic signal lamp of the present invention.

As the present invention may be embodied in several forms without departing from the spirit of essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A variable message traffic signal lamp comprising:

a main signal means for displaying conventional traffic signal lights or messages including stop, proceed, turn left or prepare to stop; and a sub-signal means located at one of the side, top, bottom or peripheral to the main signal means, and simultaneously illuminated with the main signal means at the beginning of a signal phase and gradually diminishing in illuminated extent as the signal phase in display progresses and being extinguished completely at the termination of the signal phase.

2. The variable message traffic signal lamp of claim 1, wherein the main signal means and sub-signal means are comprised of plurality of light emitting diodes (LED) regularly arranged in a matrix to display signal messages in green, red and amber.

3. The variable message traffic signal lamp of claim 1, further comprising a message display means located adjacent the main signal means and sub-signal means for displaying simple character messages.

4. The variable message traffic signal lamp of claim 3, wherein a controller unit is adopted inside of the casing of the signal lamp for operating signal programs.

5. The variable message traffic signal lamp of claim 4, wherein the controller unit is operated by remote control.

* * * * *